US010941468B2

(12) United States Patent
Ahn et al.

(10) Patent No.: US 10,941,468 B2
(45) Date of Patent: Mar. 9, 2021

(54) HIGH TENSILE STRENGTH STEEL HAVING EXCELLENT BENDABILITY AND STRETCH-FLANGEABILITY AND MANUFACTURING METHOD THEREOF

(71) Applicant: POSCO, Pohang-si (KR)

(72) Inventors: Yeon-Sang Ahn, Gwangyang-si (KR); Chang-Hyo Seo, Gwangyang-si (KR); Ki-Hyun Park, Gwangyang-si (KR)

(73) Assignee: POSCO, Pohang-si (KR)

( * ) Notice: Subject to any disclaimer, the term of this patent is extended or adjusted under 35 U.S.C. 154(b) by 26 days.

(21) Appl. No.: 16/470,710

(22) PCT Filed: Dec. 7, 2017

(86) PCT No.: PCT/KR2017/014331
§ 371 (c)(1),
(2) Date: Jun. 18, 2019

(87) PCT Pub. No.: WO2018/117500
PCT Pub. Date: Jun. 28, 2018

(65) Prior Publication Data

US 2020/0087762 A1 Mar. 19, 2020

(30) Foreign Application Priority Data

Dec. 19, 2016 (KR) ..... 10-2016-0173446

(51) Int. Cl.
*C22C 38/22* (2006.01)
*C21D 8/02* (2006.01)
(Continued)

(52) U.S. Cl.
CPC ..... *C22C 38/22* (2013.01); *C21D 8/0205* (2013.01); *C21D 8/0226* (2013.01);
(Continued)

(58) Field of Classification Search
CPC ..... C21D 2211/005; C21D 2211/008; C21D 8/0205; C21D 8/0226; C21D 8/0236;
(Continued)

(56) References Cited

U.S. PATENT DOCUMENTS

2010/0314009 A1 12/2010 Kaneko et al.
2011/0240176 A1 10/2011 Kaneko et al.
(Continued)

FOREIGN PATENT DOCUMENTS

CN 105543674 5/2016
CN 10573441 7/2016
(Continued)

OTHER PUBLICATIONS

International Search Report—PCT/KR2017/014331 dated Mar. 13, 2018.
(Continued)

*Primary Examiner* — Jenny R Wu
(74) *Attorney, Agent, or Firm* — Cantor Colburn LLP

(57) ABSTRACT

Provided is a high tensile strength steel having a tensile strength of 780 MPa grade or higher which is used for structural members of automobiles, and more specifically relates to high tensile strength steel having excellent bendability and stretch-flangeability while still satisfying characteristics of DP steels of low yield ratio and high ductility, and to a manufacturing method thereof.

10 Claims, 2 Drawing Sheets

(51) Int. Cl.

| | |
|---|---|
| ***C21D 9/46*** | (2006.01) |
| ***C23C 2/06*** | (2006.01) |
| ***C23C 2/40*** | (2006.01) |
| ***C23C 2/28*** | (2006.01) |
| ***C22C 38/38*** | (2006.01) |
| ***C22C 38/26*** | (2006.01) |
| ***C22C 38/32*** | (2006.01) |
| ***C22C 38/02*** | (2006.01) |

(52) U.S. Cl.
CPC ..... *C21D 8/0236* (2013.01); *C21D 9/46* (2013.01); *C22C 38/02* (2013.01); *C22C 38/26* (2013.01); *C22C 38/32* (2013.01); *C22C 38/38* (2013.01); *C23C 2/06* (2013.01); *C23C 2/28* (2013.01); *C23C 2/40* (2013.01); *C21D 2211/008* (2013.01)

(58) Field of Classification Search
CPC ..... C21D 8/0273; C21D 9/46; C22C 38/02; C22C 38/06; C22C 38/22; C22C 38/26; C22C 38/28; C22C 38/32; C22C 38/38; C23C 2/06; C23C 2/28; C23C 2/40
See application file for complete search history.

(56) References Cited

U.S. PATENT DOCUMENTS

| | | | |
|---|---|---|---|
| 2014/0182748 | A1 | 7/2014 | Nakagaito et al. |
| 2014/0234657 | A1 | 8/2014 | Azuma et al. |
| 2015/0101712 | A1 | 4/2015 | Futamura et al. |
| 2016/0177427 | A1 | 6/2016 | Takashima et al. |
| 2016/0186282 | A1 | 6/2016 | Han et al. |
| 2016/0312326 | A1 | 10/2016 | Drillet et al. |
| 2018/0023161 | A1 | 1/2018 | Minami et al. |

FOREIGN PATENT DOCUMENTS

| | | | |
|---|---|---|---|
| JP | 2005264176 | | 9/2005 |
| JP | 2009167467 | | 7/2009 |
| JP | 2009179852 | | 8/2009 |
| JP | 2010070843 | | 4/2010 |
| JP | 2010255094 | | 11/2010 |
| JP | 2010275627 | | 12/2010 |
| JP | 2010275627 | A * | 12/2010 |
| JP | 2015034326 | | 2/2015 |
| JP | 2015113504 | | 6/2015 |
| JP | 2016141857 | | 8/2016 |
| JP | 2017507241 | | 3/2017 |
| KR | 20100001330 | | 1/2010 |
| KR | 20110119285 | | 11/2011 |
| KR | 20130143278 | | 12/2013 |
| KR | 20140130492 | | 11/2014 |
| KR | 20150025996 | | 3/2015 |
| KR | 20150073844 | | 7/2015 |
| KR | 101620744 | | 5/2016 |
| KR | 101630975 | | 6/2016 |
| WO | 2015185956 | | 12/2015 |

OTHER PUBLICATIONS

European Search Report—European Application No. 17882503.0, dated Oct. 9, 2019, citing WO 2015/185956, JP 5 493986, US 2014/182748 and US 2014/234657.

Chinese Office Action—Chinese Application No. 201780077461.0 dated Aug. 6, 2020, citing JP 2010-275627 and CN 105734411.

Japanese Office Action—Japanese Application No. 2019-532758 dated Oct. 6, 2020, citing JP 2010-255094, JP 2016-141857, JP 2010-070843, JP 2009-179852, JP 2015-034326, and JP 2017-507241.

* cited by examiner

HIGH TENSILE STRENGTH STEEL HAVING EXCELLENT BENDABILITY AND STRETCH-FLANGEABILITY AND MANUFACTURING METHOD THEREOF

TECHNICAL FIELD

The present disclosure relates to high tensile steel used for structural members of automobiles, and more specifically, to high tensile strength steel having excellent bendability and stretch-flangeability, and a manufacturing method thereof.

BACKGROUND ART

As regulations for fuel economy in automobiles are becoming strengthened as a method of preserving the global environment, weight reductions of automobile bodies have been actively carried out. One proposal thereof is to reduce the weight of automotive materials by increasing the strength of steel sheets.

Generally, high-strength automobile materials may be classified as precipitation strengthened steel, bake hardened steel, solid solution strengthened steel, transformation strengthened steel, and the like.

Among them, dual phase steel (DP steel), transformation induced plasticity steel (TRIP steel), and complex phase steel (CP steel), and the like may be included in the transformation strengthened steel. Such transformation strengthened steel may be called advanced high strength steel (AHSS).

The DP steel may be a steel in which hard martensite is finely dispersed in soft ferrite to ensure high strength. The CP steel may be a steel including two phases or three phases of ferrite, martensite, and bainite, and including precipitation hardening element (s), such as Ti, Nb, and the like to improve strength. The TRIP steel may be a type of steel capable of causing martensite transformation to secure high strength and high ductility, when retained austenite, finely and homogeneously dispersed, is processed at room temperature.

In recent years, steel sheets for automobiles have been required to be steel sheets having higher strength to improve fuel economy or durability. In view of collision stability and passenger protection, high strength steel sheets having a tensile strength of 780 MPa or higher are increasingly used in body structures and reinforcements.

Up to now, the development of steel materials has mainly proceeded from the viewpoint of ductility and tensile strength, in order to improve stretching properties. However, in recent years, since the ductility of cut-edges sheared with a shear during machining is low in terms of ductility and tensile strength, cracks may be generated in the edge portions during machining. Particularly, in parts requiring bendability or stretch-flangeability, such as sill side, seat parts, and the like, even though the elongation thereof is excellent, when the bendability or stretch-flangeability deteriorates, the above parts may not be used as they are.

In order to solve the above problems, in automobile companies that have used the DP steel, excellent in forming of existing parts for manufacturing the above-mentioned parts, the development of the DP steel is required to satisfy the requirements of low yield ratio and high ductility, characteristic of DP steel, and excellent bendability and stretch-flangeability simultaneously.

Since steel sheets for automobiles may be required to have high corrosion resistance, hot-dip galvanized steel sheets having excellent corrosion resistance have been used.

Since such steel sheets may be manufactured through a continuous galvanizing line that performs a recrystallization annealing process and a plating process in the same line, a steel sheet having excellent corrosion resistance may be produced at relatively low cost.

Further, a galvannealed steel sheet which has been further subjected to the heat treatment, after hot-dip galvanizing, may be widely used, because it has excellent corrosion resistance as well as excellent weldability and formability.

However, it may be difficult to secure the hot dipping surface quality, due to hardenable elements and oxidizing elements such as Si, Mn, or the like, added in order to improve the strength of the steel.

Accordingly, in order to reduce the weight of automobiles, it may be required to develop a DP steel excellent in terms of bendability and stretch-flangeability, as well as a low yield ratio and a high ductility of the DP steel. In addition, development of a high tensile hot-dip galvanized steel sheet having excellent corrosion resistance and weldability may be also required.

Patent Document 1, relating to a conventional technology for improving formability in a high tensile steel sheet, discloses a method of manufacturing a high tensile strength steel sheet made of a composite structure mainly comprising martensite, and in which fine precipitated copper particles having a diameter of 1 to 100 nm are dispersed inside of the structure to improve formability.

However, since this technology requires excessive addition of Cu in an amount of 2% to 5% in order to precipitate good fine Cu particles, hot shortness due to the Cu may occur and there may be problems that the manufacturing cost increases excessively.

Meanwhile, Patent Document 2, which proposes a high-strength hot-dip galvanized steel sheet having good hole expandability, discloses a precipitation-strengthening steel sheet having a structure containing ferrite as a matrix structure and containing 2 area % to 10 area % of pearlite. The precipitation strengthening steel sheet may be a steel sheet of which strength may be improved by precipitation strengthening and grain refinement through the addition of carbon-nitride forming elements such as Nb, Ti, V, and the like. Although the hole expandability may be good, there may be problems that a limit to improving tensile strength is present, and cracks may be generated during press forming because of high yield strength and low ductility.

Another technology, Patent Document 3, discloses a method for manufacturing a composite steel sheet excellent in formability utilizing a retained austenite phase. However, this technology may be disadvantageous in that, since large amounts of Si and Al are added, it may be difficult to secure plating quality, and it may be difficult to ensure surface quality during steel making and continuous casting. Further, it may be difficult to secure a low yield ratio required by an automobile company, which causes a problem that cracks in processing occur during press forming.

(Patent Document 1) Japanese Patent Publication No. 2005-264176

(Patent Document 2) Korean Patent Publication No. 2015-0073844

(Patent Document 3) Japanese Patent Publication No. 2015-113504

DISCLOSURE

Technical Problem

An aspect of the present disclosure is to provide high tensile steel having a tensile strength of 780 MPa or higher, and more specifically, to high tensile steel which satisfies a low yield ratio and high ductility, characteristic of the DP (dual phase) steel, and has excellent bendability and stretch-flangeability simultaneously, and a manufacturing method thereof.

Technical Solution

According to an aspect of the present disclosure, high tensile strength steel having excellent bendability and stretch-flangeability, includes, by weight, carbon (C): 0.05% to 0.15%, silicon (Si): 1.5% or less (excluding 0%), manganese (Mn): 1.5% to 2.5%, molybdenum (Mo): 0.2% or less (excluding 0%), chromium (Cr): 1.5% or less (excluding 0%), phosphorus (P): 0.1% or less (excluding 0%), sulfur (S): 0.01% or less (excluding 0%), aluminum (sol.Al): 0.02% to 0.06%, titanium (Ti): 0.003% to 0.06%, niobium (Nb): 0.003% to 0.06%, nitrogen (N): 0.01% or less (excluding 0%), boron (B): 0.003% or less (excluding 0%), a remainder of iron (Fe), and other inevitable impurities; and a zinc-based plated layer on at least one surface of the base steel sheet, wherein a component relationship of Si, Mo, Cr, and C represented by the following Relationship 1 is 5 or more, the base steel sheet comprises martensite having an area fraction of 10% to 30%, tempered martensite having an area fraction of 20% to 40%, and a remainder of ferrite, as a microstructure of the base steel sheet, and at a thickness ¼t point of the base steel sheet (where t is a thickness (mm) of the steel), a hardness ratio of a martensite phase and a tempered martensite phase expressed by the following Relationship 2 is 2 or less, and a hardness ratio of a martensite phase and a ferrite phase expressed by the following Relationship 3 is 3 or less:

$$\{(Si+Cr+Mo)/C\} \geq 5 \quad \text{Relationship 1}$$

where each component refers to a weight content of the element, $$(H_M/H_{TM}) \leq 2 \quad \text{Relationship 2}$$

where M refers to martensite, and TM refers to tempered martensite, $$(H_M/H_F) \leq 3 \quad \text{Relationship 3}$$

where M refers to martensite, and F refers to ferrite.

According to an aspect of the present disclosure, a manufacturing method of high tensile strength steel having excellent bendability and stretch-flangeability, includes: heating a steel slab satisfying the above-described alloy composition and component relationships to a temperature in a range of 1050° C. to 1250° C.; finish hot-rolling the heated steel slab at a temperature within a range of Ar3+50° C. to 950° C. to produce a hot-rolled steel sheet; coiling the hot-rolled steel sheet at a temperature within a range of 400° C. to 700° C.; after the coiling, cold-rolling at a cold-rolling reduction ratio of 40% to 80% to produce a cold-rolled steel sheet; continuously annealing the cold-rolled steel sheet at a temperature within a range of Ac1+30° C. to Ac3-20° C.; after the continuously annealing, firstly cooling the cold-rolled steel sheet to a temperature within a range of 630° C. to 670° C. at a cooling rate of 2° C./s to 14° C./s; after the firstly cooling, secondly cooling the cold-rolled steel sheet in hydrogen cooling facility to a temperature within a range of 300° C. to 400° C. at a cooling rate of 10° C./s or higher; after the secondly cooling, reheating the cold-rolled steel sheet to a temperature within a range of 400° C. to 500° C.; after the reheating, hot-dip galvanizing the cold-rolled steel sheet; and after the hot-dip galvanizing, finally cooling to a temperature within a range of Ms to 100° C. at a cooling rate of 3° C./s or higher.

Advantageous Effects

According to an aspect of the present disclosure, high tensile steel which satisfies a low yield ratio and high ductility, characteristic of the DP (dual phase) steel, and has excellent bendability and stretch-flangeability simultaneously, by optimizing the alloy composition and the manufacturing conditions, may be provided.

The high tensile strength steel of the present disclosure may be applied variously as a material for structural members of automobiles, which requires various characteristics in a complex manner.

BEST MODE FOR INVENTION

Figure 1:
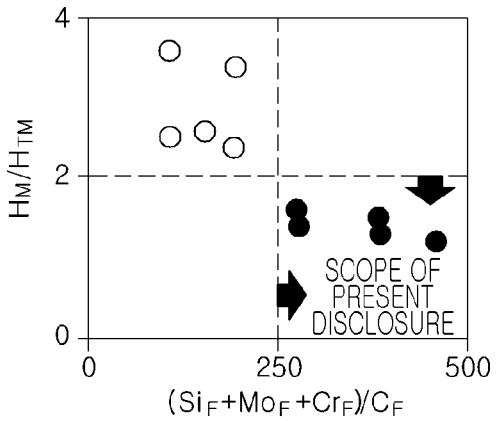
FIG. 1 is a graph illustrating a change in hardness ratios ($H_M/H_{TM}$) of an M phase and a TM phase in accordance with a content ratio (a concentration ratio) between Si, Mo, Cr, and C in ferrite at a thickness ¼t point of base steel sheets of inventive steel and comparative steel, according to an embodiment of the present disclosure.

The present inventors have intensively studied a method of satisfying both a low yield ratio and high ductility, of a conventional DP steel, and ensuring excellent bendability and stretch-flangeability simultaneously. As a result, it has been confirmed that high tensile steel having a microstructure advantageous for securing desired properties may be produced by optimizing an alloy composition and manufacturing conditions, and the present disclosure has been accomplished.

Particularly, the present disclosure may control contents of specific components in a matrix structure at a thickness ¼t point of a steel sheet (the base steel sheet), may introduce a tempered martensite phase together with a ferrite phase and a martensite phase into a final structure by optimizing manufacturing conditions, and may finely and uniformly disperse the respective phases, to exert an effect of suppressing formation of martensite bands.

It is also possible to minimize a hardness difference between phases by increasing solid solution concentrations of Si, Mo, and Cr in ferrite and lowering a C concentration of martensite due to generation of the tempered martensite. Therefore, there is a technical significance in improving the formability, bendability, and stretch-flangeability.

As described above, a composite structure in which ferrite and martensite are precisely controlled to a certain fraction or more while introducing fine tempered martensite, may be characterized by starting to be deformed at a low stress at an initial stage of plastic deformation, by reducing a yield ratio, and by increasing a strain hardening rate. In addition, such changes in microstructure have the effect of alleviating local stress and deformation, to delay the generation, growth, and coalescence of voids, thereby improving ductility.

Hereinafter, the present disclosure will be described in detail.

According to an aspect of the present disclosure, high tensile steel having excellent bendability and stretch-flangeability may be a hot-dip zinc-based plated steel sheet comprising a base steel sheet and a zinc-based plated layer on at least one surface of the base steel sheet, the base steel sheet preferably including, by weight, carbon (C): 0.05% to 0.15%, silicon (Si): 1.5% or less (excluding 0%), manganese (Mn): 1.5% to 2.5%, molybdenum (Mo): 0.2% or less (excluding 0%), chromium (Cr): 1.5% or less (excluding 0%), phosphorus (P): 0.1% or less (excluding 0%), sulfur (S): 0.01% or less (excluding 0%), aluminum (sol.Al): 0.02% to 0.06%, titanium (Ti): 0.003% to 0.06%, niobium (Nb): 0.003% to 0.06%, nitrogen (N): 0.01% or less (excluding 0%), and boron (B): 0.003% or less (excluding 0%).

Hereinafter, the reason why the alloy composition of the base steel sheet is controlled as described above will be described in detail. In this case, unless otherwise specified, the content of each alloy composition means % by weight.

C: 0.05% to 0.15%

Carbon (C) may be a main element added to reinforce the transformation structure of steel. The C may improve the strength of the steel, and may promote the formation of martensite in the composite phase steel. As the C content increases, the amount of martensite in the steel may increase.

When the content of C exceeds 0.15%, the strength of the steel may increase due to an increase in the amount of martensite in the steel, but the difference in strength between ferrites having a relatively low carbon concentration may increase. Such a difference in strength may easily cause breakage at the interface between phases at the time of stress addition, such that the bendability and the stretch-flangeability may deteriorate. In addition, when parts are processed by customers, weldability may deteriorate to cause welding defects. When the content of C is less than 0.05%, it may be difficult to secure the desired strength.

Therefore, in the present disclosure, the C content is preferably controlled to be 0.05% to 0.15%, and more preferably to be 0.06% to 0.12%.

Si: 1.5% or Less (Excluding 0%)

Silicon (Si) may be an element useful for securing strength without deteriorating the ductility of steel. The Si may be also an element promoting ferrite formation and promoting the formation of martensite by promoting C concentration to non-transformed austenite. Also, the Si may be effective to reduce the hardness difference between phases by increasing the strength of ferrite because of the ability to strengthen the solid solution.

When the content of Si exceeds 1.5%, there may be a problem that it may be difficult to secure surface quality in hot-dip galvanizing, since the plated surface quality deteriorates.

Therefore, in the present disclosure, it is preferable to control the Si content to be 1.5% or less, and 0% may be excluded. More preferably, it may be controlled to be 0.1% to 1.0%.

Mn: 1.5% to 2.5%

Manganese (Mn) may have effects of refining the particles without deteriorating the ductility, and completely precipitating sulfur (S) in the steel as MnS to prevent the hot brittleness due to the formation of FeS. The Mn may be an element which strengthens the steel, and, simultaneously, serves to lower the critical cooling rate at which the martensite phase may be obtained in the composite phase steel, and may be useful for forming martensite more easily.

When the content of Mn is less than 1.5%, the above-mentioned effect may not be obtained, and it may be difficult to secure the strength at the target level. When the content thereof exceeds 2.5%, there may be a high possibility that problems such as weldability and hot-rolling property are likely to occur, martensite may be excessively formed to cause the material unstable, and there may be a problem that an Mn-band (an Mn oxide band) in structure may be formed to increase the risk of occurrence of cracks and plate breakage in process. Further, there may be a problem that the Mn oxide may be eluted on the surface upon annealing, and the plating ability may greatly deteriorate.

Therefore, in the present disclosure, it is preferable to control the Mn content to be 1.5% to 2.5%, and more preferably to be 1.70% to 2.35%.

Mo: 0.2% or Less (Excluding 0%)

Molybdenum (Mo) may be an element added to delay the transformation of austenite into pearlite and to improve the refinement of ferrite and strength simultaneously. Such Mo may have an advantage of improving the hardenability of the steel, and thus controlling the yield ratio by finely forming martensite in grain boundaries. There may be a problem that the higher the content thereof, as an expensive element, is, the more disadvantageous it becomes in production, such that it is preferable to appropriately control the content thereof.

In order to sufficiently obtain the above-mentioned effect, it is preferable to add Mo at a maximum of 0.2%. When the content thereof exceeds 0.2%, the cost of the alloy may increase sharply, and the economical efficiency may deteriorate. In addition, there may be a problem that the ductility of the steel may deteriorate due to the excessive grain refinement and solid solution strengthening effects.

Therefore, in the present disclosure, it is preferable to control the Mo content to be 0.2% or less, and 0% may be excluded. More preferably, the Mo content may be controlled to be 0.01 to 0.15%.

Cr: 1.5% or less (excluding 0%)

Chromium (Cr) may be a component having properties similar to those of Mn, and may be an element added to improve the hardenability of the steel and to ensure high strength. Such Cr may be effective for forming martensite, and may minimize the decrease in ductility against increase in strength, which may be advantageous for producing composite phase steel having high ductility. In particular, Cr-based carbides such as $Cr_{23}C_6$ may be formed during the hot-rolling process, in which portion thereof may be partially dissolved and portion thereof may be not dissolved in the annealing process, to control the amount of solid solution C in the martensite to a proper level or lower after cooling. Therefore, it may be advantageous of manufacturing composite phase steel having a low yield ratio by suppressing occurrence of yield point-elongation (YP-El).

In the present disclosure, the addition of Cr may facilitate the formation of martensite by improving the hardenability. When the content thereof exceeds 1.5%, the martensite formation ratio may increase excessively, the Cr-based carbide fraction may increase to be coarse, and, after the annealing, the size of the martensite becomes coarse. Therefore, there may be a problem that the elongation rate may be lowered.

Therefore, in the present disclosure, the content of Cr is preferably controlled to be 1.5% or less, and 0% may be excluded.

P: 0.1% or Less (Excluding 0%)

Phosphorus (P) may be an element which may be advantageous for securing strength without greatly deteriorating the formability of steel. When the P is excessively added, the possibility of occurrence of brittle fracture may increase, to increase the possibility of plate breakage of the slab during hot-rolling, and there may be a problem that the P may be an element deteriorating the plated surface characteristics.

Therefore, it is preferable to control the P content to be 0.1% or less, but 0% may be excluded, in consideration of an amount that may be inevitably added.

S: 0.01% or Less (Excluding 0%)

Since sulfur (S) is an element which may be inevitably added as an impurity element in the steel, it is preferable to control the content thereof as low as possible. Particularly, since the S has a problem of increasing the possibility of generating the hot shortness, it is preferable to control the content to be 0.01% or less. 0% may be excluded, in consideration of an amount that may be inevitably added during the manufacturing process.

sol.Al: 0.02% to 0.06%

Soluble aluminum (sol.Al) may be an element added for refinement of grain size and deoxidation of the steel. When the content of sol.Al is less than 0.02%, it may be difficult to produce Al-killed steel in a normal stable state. When the content thereof exceeds 0.06%, it may be advantageous to increase the strength due to refinement of crystal grains. Since inclusions may be excessively formed during the continuous casting process for steelmaking, there may be a possibility that the surface of the plated steel sheet may be likely to be defective, and there may be a problem that the manufacturing cost may increase.

Therefore, in the present disclosure, it is preferable to control the content of sol.Al to be 0.02% to 0.06%.

Ti: 0.003% to 0.06%, Nb: 0.003% to 0.06%

Titanium (Ti) and niobium (Nb) may be effective elements for increasing the strength and refinement of grain size of the steel. When the contents of Ti and Nb are each less than 0.003%, the above-mentioned effect(s) may not be sufficiently ensured. When the contents of Ti and Nb are each more than 0.06%, the manufacturing cost may increase and the precipitates may be excessively generated, to greatly deteriorate ductility.

Therefore, in the present disclosure, Ti and Nb are preferably controlled to 0.003% to 0.06%, respectively.

N: 0.01% or Less (Excluding 0%)

Nitrogen (N) may be an element that may be inevitably added as an impurity element in the steel. It may be important to manage such N in its amount as low as possible, but there may be a problem that the refining cost of steel rises sharply. Therefore, it is preferable to control the content thereof to be 0.01% or less, in which the operating conditions may be carried out, but 0% may be excluded, in consideration of an amount that may be inevitably added.

B: 0.003% or Less (Excluding 0%)

Boron (B) may be an element which is advantageous for delaying transformation of austenite into pearlite during cooling in the annealing operation. When the content of B exceeds 0.003%, excessive B may be concentrated on the surface, to cause deterioration in plating adhesiveness.

Therefore, in the present disclosure, it is preferable to control the content of B to 0.003% or less, but 0% may be excluded, in consideration of an amount that may be inevitably added.

The remainder of the present disclosure may be iron (Fe). In the conventional steel manufacturing process, since impurities which are not intended from raw materials or the surrounding environment may be inevitably incorporated, the impurities may not be excluded. All of these impurities are not specifically mentioned in this specification, as they are known to anyone skilled in the art of steelmaking. Meanwhile, addition of an effective component other than the above-mentioned composition is not excluded.

In order to secure physical properties such as formability, bendability, and stretch-flangeability, which may be aimed in the present disclosure, it may be necessary to satisfy the above-described alloy composition and satisfy the following microstructure.

Specifically, in the high tensile steel of the present disclosure, the microstructure of the base steel sheet may preferably include martensite having an area fraction of 10% to 30%, tempered martensite having an area fraction of 20% to 40%, and a remainder of ferrite.

It may be important to control the phase and fraction of the structure in order to satisfy both the low yield ratio and the high ductility, which may be characteristics of the composite phase steel, i.e., the DP steel, and to secure the excellent bendability and stretch-flangeability simultaneously.

Therefore, in the present disclosure, there may be a technical feature in introducing the tempered martensite phase. In addition, the tempered martensite phase may be generated between ferrite and martensite, to reduce a difference in hardness between martensite and ferrite phases.

In this case, when a fraction of the tempered martensite phase is controlled to be 20% to 40%, it may be effective to lower the hardness difference between the phases by decreasing the C concentration of the martensite phase due to the formation of tempered martensite. When the fraction of the above-mentioned tempered martensite phase exceeds 40%, the yield strength may increase. Therefore, it may be difficult to secure low yield ratio and high ductility, characteristics of the DP steel.

When the fraction of the martensite phase is controlled to be 10% to 30% and the fraction of the ferrite phase is controlled to be 30% or more, it may be characterized by starting to be deformed at a low stress at an initial stage of plastic deformation, by reducing a yield ratio, and by increasing a strain hardening rate. In addition, such changes in structure have the effect of alleviating local stress and deformation, to delay generation, growth, and coalescence of voids, thereby improving ductility. When the fraction of the martensite phase exceeds 30%, a difference in hardness between the phases may increase, and a value of a product of bending and stretch-flangeability (HER×bending angle (3-point bending angle)) may not be secured at 3,000 or more. In this case, there may be a problem that cracks may occur at an edge portion or around a hole sheared in advance due to shear deformation at the time of forming into a component, or processed cracks may occur at a portion to be bent.

In the base steel sheet of the present disclosure having the above-mentioned microstructure, it is preferable that a component relationship of Si, Mo, Cr, and C represented by the following Relationship 1 may be 5 or more:

$$\{(Si+Cr+Mo)/C\} \geq 5 \qquad \text{Relationship 1}$$

where each component refers to a weight content of the element.

This may be to effectively reduce the difference in hardness between the phases by increasing the solid concentration of Si, Mo, and Cr in the ferrite. When the component relationship of Si, Mo, Cr, and Cat a thickness ¼*t* point of the base steel sheet (where t is a thickness (mm) of the steel) satisfies the above Relationship 1, a content ratio of Si, Mo, Cr, and C in ferrite expressed by the following Relationship 4, at a thickness ¼*t* point of the base steel sheet, may be secured to be 250 or more:

$$\{(Si_F+MO_F+Cr_F)/C_F\}\geq 250 \quad \text{Relationship 4}$$

When the value of the above Relationship 1 is less than 5, the effect of solid solution strengthening by Si, Mo, and Cr may not be sufficiently obtained. Therefore, the content ratio of Si, Mo, Cr, and C in ferrite at a thickness ¼t point of the base steel sheet (Relationship 4) may not be ensured to be 250 or more. That is, the difference in hardness between the phases may not be effectively reduced.

As described above, by satisfying the microstructure of the base steel sheet and the relationship between the alloy composition within the thickness ¼t point of the base steel sheet, a hardness ratio of a martensite phase and a tempered martensite phase expressed by the following Relationship 2 may be secured to be 2 or less, and a hardness ratio of a martensite phase and a ferrite phase expressed by the following Relationship 3 may be secured to be 3 or less:

$$(H_M/H_{TM})\leq 2 \quad \text{Relationship 2}$$

(where M refers to martensite, and TM refers to tempered martensite.)

$$(H_M/H_F)\leq 3 \quad \text{Relationship 3}$$

(where M refers to martensite, and F refers to ferrite.)

The high tensile steel of the present disclosure may have a tensile strength of 780 MPa or higher, and may have a yield ratio (YR=YS/TS) of 0.7 or less, and a value of (HER× bending angle) of 3,000 or more, to satisfy a low yield ratio and high ductility, and secure excellent bendability and stretch-flangeability simultaneously.

Hereinafter, a manufacturing method of high tensile steel having excellent bendability and stretch-flangeability, provided by the present disclosure, which may be another aspect of the present disclosure, will be described in detail.

Briefly, the present disclosure may produce the high tensile steel through operations of [steel slab heating→hot-rolling→coiling→cold-rolling→continuous annealing→cooling→reheating→hot-dip galvanizing→cooling], and the process conditions in the respective operations will be described in detail below.

[Steel Slab Heating]

First, a steel slab having the above-mentioned component system may be heated. This operation may be performed to smoothly perform a subsequent hot-rolling operation, and to sufficiently obtain properties of a target steel sheet. In the present disclosure, the process conditions of the heating operation are not particularly limited, and they may be conventional conditions. As an example, a reheating operation may be performed at a temperature within a range of 1050° C. to 1250° C.

[Hot-Rolling]

The hot-rolled steel sheet is preferably produced by subjecting the heated steel slab to a finish hot-rolling operation at a temperature within a range of the Ar3 transformation point or higher.

More preferably, the finish hot-rolling operation may be performed at a temperature within a range of Ar3+50° C. to 950° C. When a finish hot-rolling temperature is lower than Ar3+50° C., two-phase rolling of the ferrite and austenite may be performed to cause heterogeneity of material. When the temperature exceeds 950° C., there may be a possibility that the heterogeneity of material may occur due to the formation of an abnormal coarse grains by a high-temperature rolling. Therefore, coil twisting phenomenon may occur during a cooling process of the hot-rolled steel sheet, which is not preferable.

[Coiling]

It is preferable to coil the hot-rolled steel sheet produced in accordance with the above.

The coiling process is preferable to be carried out at a temperature within a range of 400° C. to 700° C. When the coiling temperature is lower than 400° C., the strength of the hot-rolled steel sheet may increase excessively, due to excessive formation of martensite or bainite. Therefore, there may be problems such as defects in shape, and the like due to load of a subsequent cold-rolling process. When the coiling temperature exceeds 700° C., surface concentration of the elements such as Si, Mn, and B in the steel, which deteriorate the wettability of hot-dip galvanized steel, may increase.

[Cold-Rolling]

The coiled hot-rolled steel sheet is preferably cold-rolled to produce a cold-rolled steel sheet.

The cold-rolling process is preferably performed at a cold-rolling reduction ratio of 40% to 80%. When the cold-rolling reduction ratio is less than 40%, it may be difficult to secure a desired thickness, and it may be difficult to correct a shape of the steel sheet. When the cold-rolling reduction ratio exceeds 80%, there may be a high possibility that cracks may be generated in an edge portion of the steel sheet, which causes a problem in a cold-rolling load.

[Continuous Annealing]

It is preferable to continuously anneal the cold-rolled steel sheet produced according to the above. The continuous annealing process may be performed, for example, in a continuous galvanizing line (CGL) or continuous galvannealing line.

The continuous annealing process may be provided to form ferrite and austenite phases and to decompose carbon, simultaneously with recrystallization.

The continuous annealing process is preferably performed at a temperature within a range of Ac1+30° C. to Ac3-20° C., more advantageously at a temperature within a range of 780° C. to 830° C.

When the temperature thereof is less than Ac1+30° C. during the continuous annealing, sufficient recrystallization may not be achieved, and sufficient austenite formation may be difficult, such that the target level of martensite phase and tempered martensite phase fraction may not be obtained after the annealing. When the continuous annealing temperature exceeds Ac3-20° C., the productivity may be lowered, the austenite phase may be excessively formed, and the tempered martensite fraction after the cooling may greatly increase, to generate problems of increasing the yield strength and decreasing the ductility. In addition, there may be a problem that the surface concentration of the elements such as Si, Mn, and B, which inhibits the wettability of the hot-dip galvanizing, may become serious to lower the quality of the plated surface.

[Cooling]

It is preferable that the cold-rolled steel sheet subjected to the continuous annealing process according to the above may be cooled in a step-wise manner.

Specifically, it is preferable that the cooling process may be firstly cooled to a temperature within a range of 630° C. to 670° C. at an average cooling rate of 2° C./s to 14° C./s, then secondly cooled to a temperature within a range of 300°

C. to 400° C., more advantageously to a temperature within a range of Ms to Ms-50° C. at an average cooling rate of 10° C./s or higher.

When a stop temperature for the first cooling process is less than 630° C., due to the low temperature, proliferation activity of carbon may be low to increase carbon concentration of the ferrite. Therefore, the yield ratio may increase, and crack in processing may occur. When the stop temperature exceeds 670° C., it may be advantageous in terms of diffusion of carbon, but may have the disadvantage that requirements for the cooling rate in excessively high ranges during a second cooling process, which is a subsequent processing, should be satisfied. In addition, when an average cooling rate for the first cooling is less than 2° C./s, it may be disadvantageous in terms of productivity. When the average cooling rate exceeds 14° C./s, a carbon diffusion may not take place sufficiently, thereby not preferable.

It is preferable to carry out the second cooling process, after completion of the first cooling process under the above-mentioned conditions. When a stop temperature for the second cooling is less than 300° C., the fraction of the martensite phase may increase excessively, not to secure a low yield ratio. When the stop temperature exceeds 400° C., the martensite phase may not be sufficiently secured, such that a sufficient amount of the tempered martensite phase may not be secured in a subsequent process. As a result, the difference in hardness between phases may not be effectively lowered. When an average cooling rate for the second cooling is less than 10° C./s, the martensite phase may not be sufficiently formed.

More preferably, it is advantageous to be carried out at an average cooling rate of 15° C./s or higher, and an upper limit thereof is not particularly limited, and may be selected in consideration of a cooling facility.

It is preferable that the second cooling process uses a hydrogen cooling facility using hydrogen gas ($H_2$ gas). As described above, cooling by using the hydrogen cooling facility may have an effect of suppressing surface oxidation that may occur during the second cooling.

[Reheating]

It is preferable that the cold-rolled steel sheet in which the cooling process is completed, according to the above, is reheated to a predetermined temperature range, such that the martensite phase formed in the cooling process may be tempered to form a tempered martensite phase.

In order to sufficiently secure the tempered martensite phase, it is preferable to perform the reheating process at a temperature within a range of 400° C. to 500° C. When the temperature is lower than 400° C. at the time of reheating, softening may be insufficient due to tempering of the martensite, and hardness of the tempered martensite may increase, to have a problem increasing the difference in hardness between phases. When the temperature exceeds 500° C., the softening by tempering of martensite may increase excessively, and the desired strength may not be secured.

[Hot-Dip Galvanizing]

It is preferable that the reheated cold-rolled steel sheet according to the above may be immersed in a hot-dip zinc-based plating bath to produce a hot-dip zinc-based plated steel sheet.

In this case, the hot-dip galvanizing process may be carried out under conventional conditions, but may be carried out at a temperature within a range of 430° C. to 490° C., for example. A composition in the hot-dip zinc-based plating bath during the hot-dip galvanizing process is not particularly limited, and may be a composition for a pure galvanizing bath, or a composition for a zinc-based alloy plating bath containing Si, Al, Mg, or the like.

[Final Cooling]

After completion of the hot-dip galvanizing process, it is preferable to cool the hot-dip galvanized steel sheet to a temperature within a range of Ms to 100° C. at a cooling rate of 3° C./s or higher. In this process, a fresh martensite phase may be formed in the base steel sheet.

When the stop temperature for the cooling process exceeds Ms, the martensite phase may not be sufficiently secured. When the temperature is lower than 100° C., a defect in plate shape may be caused. When the average cooling rate thereof is less than 3° C./s, there may be a problem that the martensite may be formed heterogeneously, due to a too slow cooling rate.

As necessary, the hot-dip zinc-based plated steel sheet may be subjected to an alloying heat treatment before the final cooling process, to obtain an alloyed hot-dip zinc-based plated steel sheet. In the present disclosure, the condition of the alloying heat treatment is not particularly limited, and may be a conventional condition. As an example, an alloying heat treatment may be performed at a temperature within a range of 480° C. to 600° C.

Next, as necessary, the final cooled hot-dip zinc-based plated steel sheet or the alloyed hot-dip zinc-based plated steel sheet may be subjected to a temper rolling process, to form a large amount of dislocation in the ferrite disposed around the martensite. Therefore, the bake hardenability may be further improved.

In this case, a reduction ratio is preferably less than 1.0% (excluding 0%). When the reduction ratio is 1.0% or more, it may be advantageous in terms of formation of dislocation, but it may cause side effects such as occurrence of plate breakage, and the like, due to facility capability limit.

A high tensile steel of the present disclosure produced according to the above-mentioned conditions may include martensite having an area fraction of 10% to 30%, tempered martensite having an area fraction of 20% to 40%, and a remainder of ferrite, as a microstructure of the base steel sheet. Further, a concentration ratio of Si, Mo, Cr, and C in ferrite in a matrix structure at a thickness ¼*t* point of a base steel sheet (Relationship 4) may be 250 or more, a hardness ratio ($H_M/H_{TM}$) of an M phase and a TM phase in a matrix structure at a thickness ¼*t* point of the base steel sheet may be 2 or less, and a hardness ratio ($H_M/H_F$) of an M phase and an F phase may be 3 or less, there may be an effect that a difference in hardness between phases is low. In addition, since a yield ratio may be as low as 0.7 or less, and a product of HER and 3-point bending angle (HER×bending angle) may be 3000 or more, there may be an effect that bendability and stretch-flangeability are excellent.

MODE FOR INVENTION

In the description below, an example embodiment of the present disclosure will be described in greater detail. It should be noted that the example embodiments are provided to describe the present disclosure in greater detail, and to not limit the scope of rights of the present disclosure. The scope of rights of the present disclosure may be determined on the basis of the subject matters recited in the claims and the matters reasonably inferred from the subject matters.

Example

Steel slabs having alloy compositions illustrated in the following Table 1 were prepared. The steel slabs were heated to a temperature in a range of 1050° C. to 1250° C., and were then finish hot-rolled at a temperature within a range of Ar3+50° C. to 950° C. to produce a hot-rolled steel sheet. Each hot-rolled steel sheet thus prepared was pickled, was coiled at a temperature within a range of 400° C. to 700° C., and was then cold-rolled at a cold-rolling reduction ratio of 40% to 80% to produce a cold-rolled steel sheet Then, each of the cold-rolled steel sheet was continuously annealed under conditions illustrated in the following Table 2, and was reheated through first and second cooling processes. In this case, a continuous annealing temperature, a second cooling stop temperature, and a reheating temperature were performed under the conditions illustrated in the following Table 2, and the first cooling process, after the continuous annealing process, was performed to a temperature within a range of 630° C. to 670° C. at a cooling rate of 2° C./s to 14° C./s, and the subsequent second cooling process was performed at a cooling rate of 10° C./s or higher.

Thereafter, in a hot-dip galvanizing bath at a temperature within a range of 430° C. to 490° C., a galvanization process was performed, a final cooling process was performed, and a skin pass rolling was performed to less than 1%, to prepare hot-dip zinc-based plated steel sheets.

Microstructure was observed on each of the hot-dip zinc-based plated steel sheets prepared as described above, and mechanical and plating characteristics were evaluated. The results therefrom were illustrated in the following Table 3.

A tensile test for each specimen was conducted in an L direction using the ASTM standard. In addition, a hole expansion ratio (HER) was evaluated by applying the JSF T1001-1996 standard (Japan), and a 3-point bending test was conducted using the German Vehicle Association (VDA, Verband Der Automobilindustrie) 238-100 standard, to evaluate bending angle (180°-bending angle). It was evaluated that the bendability was superior, as the bending angle was larger, in the above 3-point bending test.

A microstructure fraction was measured by analyzing a matrix structure at a thickness ¼t point of the base steel sheet and using the results derived therefrom. Specifically, after Nital corrosion, martensite, tempered martensite, and ferrite fractions were measured using an FE-SEM and an image analyzer. Concentrations of Si, Mo, Cr, and C in the ferrite were measured by a transmission electron microscopy (TEM), an energy dispersive spectroscopy (EDS), and an ELLS analyzer at a thickness ¼t point of the base steel sheet. Hardness between phases was measured 10 times using a Vickers Micro Hardness Tester, and an average value was taken from the results.

TABLE 1

| | Alloying Composition (wt %) | | | | | | | | | | | | Component |
|---|---|---|---|---|---|---|---|---|---|---|---|---|---|
| Steel | C | Si | Mn | Mo | Cr | P | S | Sol.Al | Ti | Nb | N | B | Ratio |
| *IS1 | 0.100 | 0.52 | 2.35 | 0.005 | 0.300 | 0.015 | 0.005 | 0.024 | 0.003 | 0.020 | 0.005 | 0.0003 | 8.3 |
| IS2 | 0.069 | 0.81 | 2.30 | 0.020 | 0.005 | 0.050 | 0.006 | 0.026 | 0.003 | 0.020 | 0.003 | 0.0004 | 12.1 |
| IS3 | 0.071 | 0.11 | 1.80 | 0.030 | 1.010 | 0.030 | 0.007 | 0.043 | 0.020 | 0.050 | 0 004 | 0.0004 | 16.2 |
| IS4 | 0.060 | 0.41 | 2.00 | 0.120 | 0.850 | 0.040 | 0.003 | 0.030 | 0.020 | 0.050 | 0.006 | 0.0012 | 23.0 |
| IS5 | 0.100 | 0.60 | 2.00 | 0.050 | 0.510 | 0.010 | 0.005 | 0.040 | 0.010 | 0.020 | 0.005 | 0.0011 | 11.6 |
| **CS1 | 0.140 | 0.20 | 2.12 | 0.002 | 0.260 | 0.010 | 0.002 | 0.040 | 0.015 | 0.022 | 0.002 | 0.0004 | 3.3 |
| CS2 | 0.090 | 0.10 | 2.10 | 0.008 | 0.220 | 0.012 | 0.005 | 0.020 | 0.024 | 0.033 | 0.005 | 0.0014 | 3.6 |
| CS3 | 0.140 | 0.04 | 1.99 | 0.180 | 0.350 | 0.010 | 0.006 | 0.050 | 0.004 | 0.013 | 0.003 | 0.0008 | 4.1 |
| CS4 | 0.144 | 0.18 | 1.80 | 0.003 | 0.400 | 0.050 | 0.004 | 0.060 | 0.010 | 0.017 | 0.004 | 0.0011 | 4.0 |
| CS5 | 0.140 | 0.10 | 2.40 | 0.120 | 0.100 | 0.030 | 0.002 | 0.060 | 0.003 | 0.020 | 0.003 | 0.0010 | 2.3 |

*IS: Inventive Steel,
**CS: Comparative Steel (Component ratios in Table 1 refer to component relationship values of {(Si+Cr+Mo)/C} of the base steel sheet.)

TABLE 2

| Steel | Annealing Temp. (° C.) | 2nd Cooling Stop Temp. (° C.) | Reheating Temp. (° C.) |
|---|---|---|---|
| *IS1 | 820 | 329 | 470 |
| IS2 | 790 | 300 | 456 |
| IS3 | 800 | 360 | 481 |
| IS4 | 800 | 320 | 447 |
| IS5 | 830 | 380 | 421 |
| **CS1 | 780 | 440 | 361 |
| CS2 | 780 | 400 | 344 |
| CS3 | 780 | 360 | 280 |
| CS4 | 830 | 280 | 520 |
| CS5 | 840 | 320 | 540 |

*IS: Inventive Steel,
**CS: Comparative Steel

TABLE 3

| | Microstructure | | | Mechanical Properties | | | | | | | Hardness Ratio | | | |
|---|---|---|---|---|---|---|---|---|---|---|---|---|---|---|
| Steel | F (%) | M (%) | TM (%) | YS (MPa) | TS (MPa) | El (%) | YR | HER (%) | Bending Angle (°) | HER × Bending Angle | $H_M/H_{TM}$ | $H_M/H_F$ | Conc. Ratio | Non-Plated |
| *IS1 | 47 | 17 | 36 | 536 | 830 | 19 | 0.65 | 35 | 111 | 3885 | 1.6 | 2.6 | 267 | No |
| IS2 | 49 | 20 | 31 | 541 | 817 | 20 | 0.66 | 31 | 114 | 3534 | 1.4 | 2.6 | 273 | No |

TABLE 3-continued

| | Microstructure | | | Mechanical Properties | | | | | | | Hardness Ratio | | | |
|---|---|---|---|---|---|---|---|---|---|---|---|---|---|---|
| Steel | F (%) | M (%) | TM (%) | YS (MPa) | TS (MPa) | El (%) | YR | HER (%) | Bending Angle (°) | HER × Bending Angle | $H_M/H_{TM}$ | $H_M/H_F$ | Conc. Ratio | Non-Plated |
| IS3 | 47 | 24 | 29 | 507 | 832 | 20 | 0.61 | 35 | 110 | 3850 | 1.5 | 2.4 | 377 | No |
| IS4 | 47 | 28 | 25 | 554 | 825 | 19 | 0.67 | 33 | 122 | 4026 | 1.2 | 2.1 | 457 | No |
| IS5 | 43 | 19 | 38 | 571 | 839 | 19 | 0.68 | 31 | 121 | 3751 | 1.3 | 2.5 | 457 | No |
| **CS1 | 59 | 38 | 3 | 502 | 874 | 19 | 0.57 | 23 | 92 | 2116 | 2.6 | 3.6 | 153 | No |
| CS2 | 58 | 35 | 7 | 486 | 841 | 20 | 0.58 | 25 | 98 | 2450 | 2.5 | 3.4 | 149 | No |
| CS3 | 56 | 33 | 11 | 498 | 836 | 18 | 0.60 | 26 | 101 | 2626 | 2.4 | 3.2 | 225 | No |
| CS4 | 42 | 9 | 49 | 648 | 768 | 14 | 0.84 | 41 | 124 | 5084 | 3.4 | 4.1 | 193 | No |
| CS5 | 40 | 7 | 53 | 621 | 764 | 15 | 0.81 | 44 | 127 | 5588 | 3.6 | 4.3 | 107 | Yes |

*IS: Inventive Steel,
**CS: Comparative Steel (In Table 3, F refers to ferrite, M refers to martensite, TM refers to tempered martensite, YS refers to yield strength, TS refers to tensile strength, El refers to elongation, and YR refers to a yield ratio. The hardness ratio refers to Vickers hardness value measured at a thickness ¼t point of the base steel sheet, and the concentration ratio refers to a content ratio $((Si_F+MO_F+Cr_F)/C_F)$ of Si, Mo, Cr, and C represented by Relationship 4 in the present disclosure.

As illustrated in the above Tables 1 and 2, since Inventive Steels 1 to 5, in which the steel alloy composition, the composition ratio, and the manufacturing conditions satisfied all the requirements proposed in the present disclosure, had yield ratios as low as 0.7 or less and HER×bending angle values of 3000 or more, all the inventive steels can be seen to ensure excellent formability. In addition, it can be seen that all the inventive steels have good plating properties.

Since Comparative Steels 1 to 5, in which at least one of the steel alloy composition, the composition ratio, and the manufacturing conditions deviated from the requirements proposed in the present disclosure, had yield ratios higher than 0.7, and Comparative Steels 1 to 3 among them had a HER×bending angle value of less than 3000, the comparative steels can be seen that the formability may not be secured. In the case of Comparative Steel 5, the plating property also deteriorated to cause a non-plated state.

FIG. 1 illustrates a change in hardness ratios $(H_M/H_{TM})$ of an M phase and a TM phase in accordance with a content ratio (a concentration ratio) between Si, Mo, Cr, and C in ferrite at a thickness ¼t point of base steel sheets of inventive steel and comparative steel, and can be seen that, when a value of the concentration ratio is 250 or more, the concentration ratio between the M phase and the TM phase was 2 or less.

Figure 2:
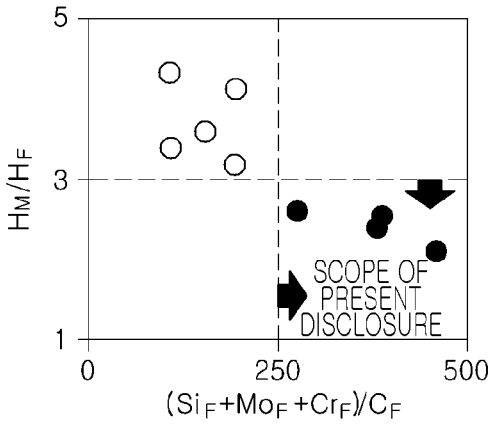
FIG. 2 is a graph illustrating a change in hardness ratios ($H_M/H_F$) of an M phase and an F phase in accordance with a content ratio (a concentration ratio) between Si, Mo, Cr, and C in ferrite at a thickness ¼t point of base steel sheets of inventive steel and comparative steel, according to an embodiment of the present disclosure.

FIG. 2 illustrates a change in hardness ratios $(H_M/H_F)$ of an M phase and an F phase in accordance with a content ratio (a concentration ratio) between Si, Mo, Cr, and C in ferrite at a thickness ¼t point of base steel sheets of inventive steel and comparative steel, and can be seen that, when a value of the concentration ratio is 250 or more, the concentration ratio between the M phase and the F phase was 3 or less.

Figure 3:
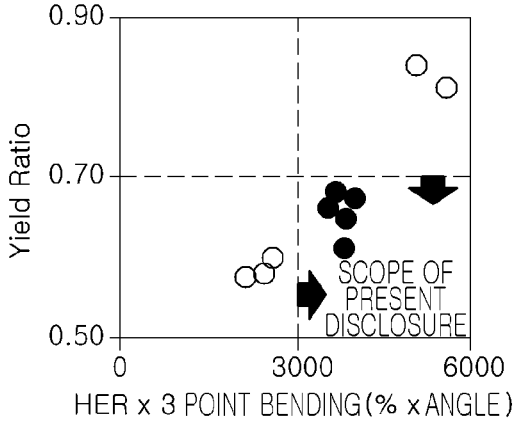
FIG. 3 illustrates values of a product of hole expansion ratio (HER) value and 3-point bending angle (HER×3-point bending angle), and a yield ratio, in inventive steel and comparative steel, according to an embodiment of the present disclosure.

FIG. 3 illustrates values of a product of hole expansion ratio (HER) value and 3-point bending angle (HER×3-point bending angle), and a yield ratio, in inventive steel and comparative steel, and can be seen that, in the case of the inventive steels, the yield ratios were 0.7 or less to have low yield ratio, and the values of (HER×3-point bending angle) were secured at 3000 or more.

While example embodiments have been illustrated and described above, it will be apparent to those skilled in the art that modifications and variations could be made without departing from the scope of the present invention as defined by the appended claims.

The invention claimed is:

1. A steel comprising: a base steel sheet comprising, by weight, carbon (C): 0.05% to 0.15%, silicon (Si): 1.5% or less excluding 0%, manganese (Mn): 1.5% to 2.5%, molybdenum (Mo): 0.2% or less excluding 0%, chromium (Cr): 1.5% or less excluding 0%, phosphorus (P): 0.1% or less excluding 0%, sulfur (S): 0.01% or less excluding 0%, aluminum (sol. Al): 0.02% to 0.06%, titanium (Ti): 0.003% to 0.06%, niobium (Nb): 0.003% to 0.06%, nitrogen (N): 0.01% or less excluding 0%, boron (B): 0.003% or less excluding 0%, and a remainder of iron (Fe) and inevitable impurities; and a zinc-based plated layer on at least one surface of the base steel sheet, wherein contents of the Si, the Mo, the Cr, and the C satisfy the following Relationship:

$$\{(Si+Cr+Mo)/C\}\geq 5, \quad \text{Relationship 1}$$

wherein the base steel sheet comprises a microstructure including: a martensite phase having an area fraction of 10% to 30%, a tempered martensite phase having an area fraction of 20% to 40%, and a remainder of a ferrite phase, wherein a hardness ratio of the martensite phase and the tempered martensite phase satisfies the following Relationship 2 at a ¼t point of the base steel sheet where t is a thickness (mm) of the base steel sheet:

$$(H_M/H_{TM})\leq 2 \quad \text{Relationship 2}$$

where $H_M$ refers to a hardness of the martensite phase, and $H_{TM}$ refers to a hardness of the tempered martensite phase, and wherein a hardness ratio of the martensite phase and the ferrite phase satisfies the following Relationship 3:

$$(H_M/H_F)\leq 3 \quad \text{Relationship 3}$$

where $H_M$ refers to a hardness of the martensite phase, and $H_F$ refers to a hardness of the ferrite phase.

2. The high tensile steel according to claim 1, wherein, at the ¼t point of the base steel sheet, contents of the Si, the Mo, the Cr, and the C in the ferrite phase satisfy the following Relationship 4:

$$\{(Si_F+Mo_F+Cr_F)/C_F\}\geq 250 \quad \text{Relationship 4}$$

where $Si_F$, $Mo_F$, $Cr_F$, and $C_F$ refer to contents of the Si, the Mo, the Cr, and the C in the ferrite phase, respectively.

3. The steel according to claim 1, wherein the steel has a tensile strength of 780 MPa or higher, a yield ratio of 0.7 or less, and a value of (hole expansion ratio×bending angle) of 3,000 or more.

4. A manufacturing method of a steel, the method comprising:

heating a steel slab to a temperature in a range of 1050° C. to 1250° C. to produce a heated steel slab, wherein the steel slab comprises, by weight, carbon (C): 0.05% to 0.15%, silicon (Si): 1.5% or less excluding 0%, manganese (Mn): 1.5% to 2.5%, molybdenum (Mo): 0.2% or less excluding 0%, chromium (Cr): 1.5% or less excluding 0%, phosphorus (P): 0.1% or less excluding 0%, sulfur (S): 0.01% or less excluding 0%, aluminum (sol. Al): 0.02% to 0.06%, titanium (Ti): 0.003% to 0.06%, niobium (Nb): 0.003% to 0.06%, nitrogen (N): 0.01% or less excluding 0%, boron (B): 0.003% or less excluding 0%, and a remainder of iron (Fe) and inevitable impurities, and contents of the Si, the Mo, the Cr, and the C satisfying the following Relationship 1:

$$\{(Si+Cr+Mo)/C\} \geq 5; \quad \text{Relationship 1}$$

hot-finish rolling the heated steel slab at a temperature within a range of Ar3+50° C. to 950° C. to produce a hot-rolled steel sheet;

coiling the hot-rolled steel sheet at a temperature within a range of 400° C. to 700° C.;

after the coiling, cold-rolling the hot-rolled steel sheet at a cold-rolling reduction ratio of 40% to 80% to produce a cold-rolled steel sheet;

continuously annealing the cold-rolled steel sheet at a temperature within a range of Ac1+30° C. to Ac3−20° C. to produce an annealed steel sheet;

firstly cooling the annealed steel sheet to a temperature within a range of 630° C. to 670° C. at a cooling rate of 2° C./s to 14° C./s to produce a firstly cooled steel sheet;

secondly cooling the firstly cooled steel sheet in a hydrogen cooling facility to a temperature within a range of 300° C. to 400° C. at a cooling rate of 10° C./s or higher to produce a secondly cooled steel sheet;

reheating the secondly cooled steel sheet to a temperature within a range of 400° C. to 500° C. to produce a reheated steel sheet;

hot-dip galvanizing the reheated steel sheet to produce a galvanized steel sheet; and finally cooling the galvanized steel sheet to a temperature within a range of Ms to 100° C. at a cooling rate of 3° C./s or higher.

5. The method according to claim 4, wherein the reheating forms a tempered martensite phase.

6. The method according to claim 4, wherein the finally cooling forms a fresh martensite phase.

7. The method according to claim 4, wherein the continuously annealing is performed at a temperature within a range of 780° C. to 830° C.

8. The method according to claim 4, wherein the hot-dip galvanizing is performed in a zinc galvanizing bath at a temperature within a range of 430° C. to 490° C.

9. The method according to claim 4, further comprising: performing an alloying heat treatment after the hot-dip galvanizing and before the finally cooling.

10. The method according to claim 4, further comprising: performing a skin pass rolling at a reduction ratio of less than 1.0%, after the finally cooling.

* * * * *